United States Patent [19]

Day

[11] Patent Number: 4,697,538

[45] Date of Patent: Oct. 6, 1987

[54] BOAT DOCK MOORING DEVICE

[76] Inventor: Robert C. Day, Rt. 3, Box 634K, New Iberia, La. 70560

[21] Appl. No.: 852,218

[22] Filed: Apr. 15, 1986

[51] Int. Cl.[4] ..... B63B 21/00

[52] U.S. Cl. ..... 114/230; 114/343

[58] Field of Search ..... 114/230, 343, 364, 219, 114/218, 381, 250, 249; 441/3, 5; 267/63 R, 153, 158, 160; 280/186, 187, 485, 512

[56] References Cited

U.S. PATENT DOCUMENTS

| | | | |
|---|---|---|---|
| 2,569,783 | 10/1951 | Smith | 114/230 |
| 2,878,036 | 3/1959 | Simmons | 280/485 |
| 3,307,514 | 3/1967 | Young | 114/230 |
| 4,066,030 | 1/1978 | Milone | 114/230 |
| 4,144,831 | 3/1979 | Heydolph | 114/230 |
| 4,459,930 | 7/1984 | Flory | 441/5 |
| 4,590,634 | 5/1986 | Williams | 114/230 |

*Primary Examiner*—Joseph F. Peters, Jr.
*Assistant Examiner*—Clifford T. Bartz
*Attorney, Agent, or Firm*—Harvey B. Jacobson

[57] ABSTRACT

A mooring arm structure is provided including a first elongated arm mounted at one end for angular displacement relative to a dock supported mount about a horizontal axis extending transversely of the first arm and with the second free end of the first arm projecting outwardly beyond one marginal portion of the dock. The second end of the first arm has the upper end of a depending second arm anchored relative thereto and the second arm is constructed of shape retentive resilient material. The lower end of the second arm has a ball hitch socket assembly supported therefrom and an airplace-type shock absorber is connected between the lower end of the second arm and a longitudinal midportion of the first arm.

In a modified form of the invention, the mount is supported from the dock marginal portion for vertical guided shifting therealong and motor structure is operatively connected thereto for raising and lowering the mount responsive to excessive raising and lowering, respectively, of the second end of the first arm.

8 Claims, 6 Drawing Figures

BOAT DOCK MOORING DEVICE

BACKGROUND OF THE INVENTION

1. Field of the Invention

This invention relates to a mooring apparatus which may be used singly or in pairs for mooring a water vessel relative to a dock structure in a manner allowing rolling, pitching, and slight yawing movement of the water vessel relative to the dock structure as a result of wave action on the water vessel and with the mooring structure yielding resisting horizontal displacement of the water vessel toward and away from the dock structure.

2. Description of Related Art

Various different forms of boat mooring apparatuses including some of the general structural and operational features of the instant invention heretofore have been provided such as those disclosed in U.S. Pat. Nos. 2,569,783, 2,878,036, 3,307,514, 3,981,261, 3,990,722, 4,066,030, 4,144,831, 4,459,930 and Re. 25,372. However, these previously known devices do not include the overall combination of structural features of the instant invention which coact to provide an efficient and long lasting mooring device of the type desired.

SUMMARY OF THE INVENTION

The mooring device of the instant invention incorporates a pair of mooring arm structure each including a generally horizontally disposed first arm pivotally supported from a mount anchored relative to a dock and with the first arms angularly displaceable relative to the respective mounts about generally aligned horizontal axes extending transversely of first ends of the arms. The mounts are spaced along a generally straight marginal portion of the dock and the second free ends of the first arms include depending second arms supported therefrom constructed of shape retentive and resilient material. The lower ends of the second arms carry anchor structure therefrom for releasable universal connection with water vessel mooring fixtures spaced along one marginal portion of a water vessel. In addition, elongated airplane-type shock absorbers are connected between the lower ends of the second arms and longitudinal midportions of the first arms.

A modified form of the disclosed invention includes mount portions for the mooring arm structures mounted from the associated dock for guided vertical movement therealong and have reversible motor structure operatively connected thereto for raising and lowering the mounts relative to the dock structure responsive to excessive upward and downward movements, respectively, of the free ends of the mooring arm structures.

The main object of this invention is to provide a water vessel mooring device specifically adapted to moor fore and aft portions of a water vessel to an associated dock in a manner which will modulate the mooring restraint stresses which must be absorbed by a water vessel hull during high wind and rough water situations and also when the water vessel hull is violently acted upon by the wake of a passing hull.

Another object of this invention is to provide a mooring device in accordance with the preceding objects and which will allow roll, pitch and yaw movements of the associated water vessel hull relative to the dock to which the hull is moored.

Still another important object of this invention is to provide a boat mooring device constructed in a manner which will facilitate predetermined positioning of a water vessel hull relative to a dock to which the hull is moored through the mooring device of the instant invention.

Another object of this invention is to provide a boat mooring device in accordance with the preceding objects and which includes structure for compensating for tides above and below normal high and normal low tides.

A final object of this invention to be specifically enumerated herein is to provide a mooring device in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
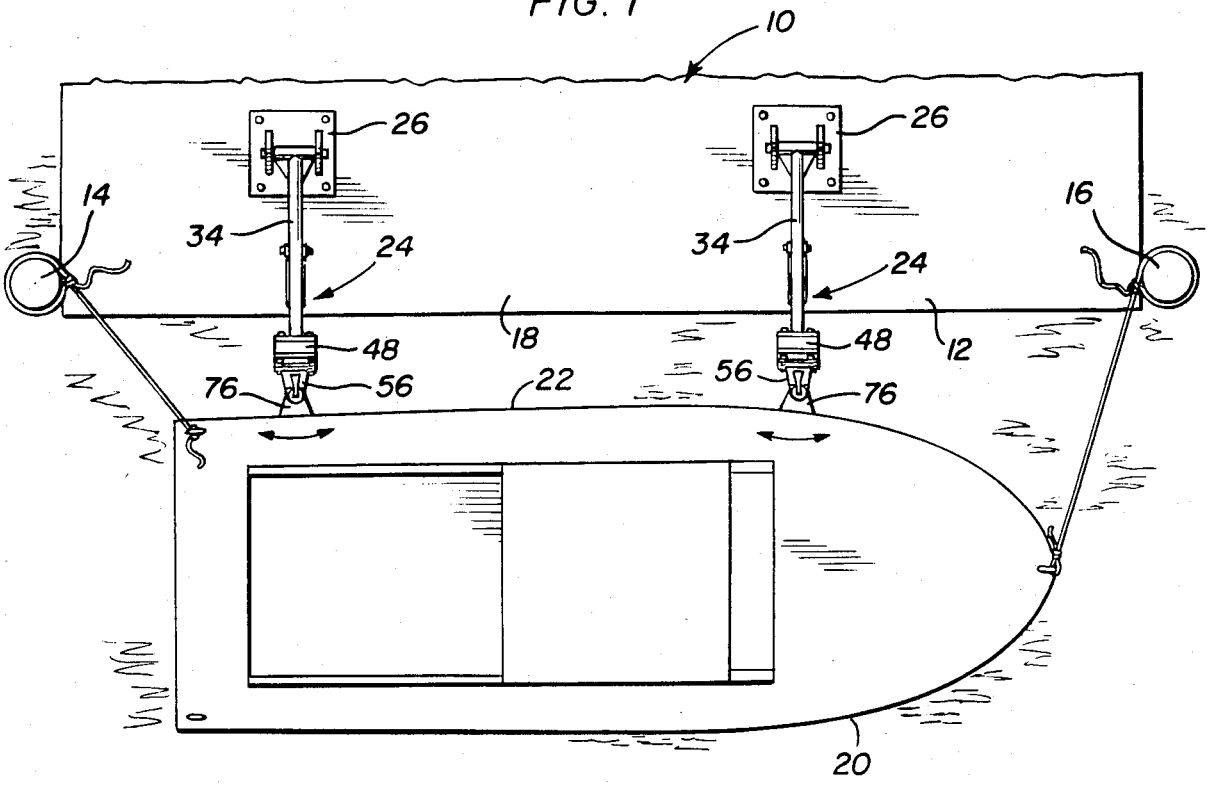
FIG. 1 comprises the top plan view of a water vessel moored alongside one marginal portion of a dock through the utilization of the boat mooring device of the instant invention, supplemental mooring lines also being connected between the dock and the vessel.
Figure 2:
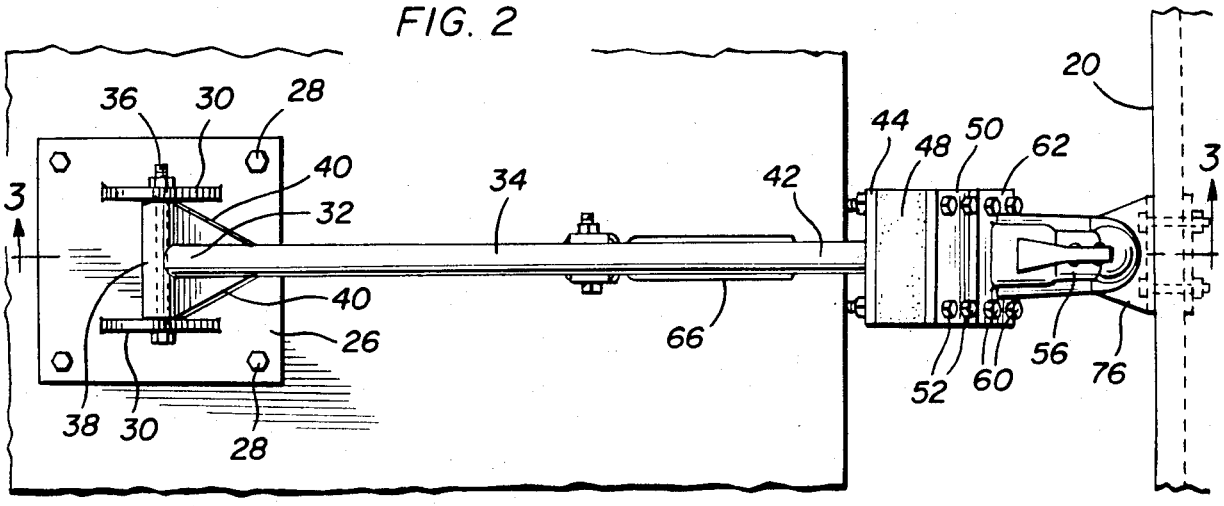
FIG. 2 is an enlarged fragmentary top plan view of one of the mooring devices.
Figure 4:
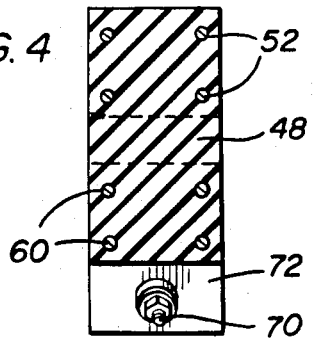
FIG. 4 is an enlarged vertical sectional view taken substantially upon the plane indicated by the section line 4—4 of FIG. 3.

Referring now more specifically to the drawings, the numeral 10 generally designates a dock including a generally straight marginal portion 12 at the opposite ends of which a pair of pilings 14 and 16 are disposed. The dock 10 includes a flooring 18 defining the marginal portion 12 extending between the pilings 14 and 16.

A water vessel 20 is disposed along the marginal portion 12 and includes a portside 22 opposing the marginal portion 12.

The boat mooring device of the instant invention includes a pair of mooring arm structures referred to in general by the reference numeral 24 and each structure 24 includes a mount 26 secured to the flooring 18 by suitable fasteners 28. Each mount 26 includes a pair of upstanding flanges 30 between which a first end 32 of a first arm 34 is pivotally mounted by a pivot fastener 36. The first end 32 includes a transverse sleeve 38 secured thereto through which the fastener 36 extends and the sleeve 38 is braced relative to the arm 34 by opposite side gusset plates 40.

The first arm 34 includes a second free end 42 to which a transverse mounting plate 44 is secured and the first end 46 of a second arm 48 is secured to the mounting plate 44 through the utilization of a clamp plate 50 and a plurality of fasteners 52 secured through the plates 44 and 50 as well as the first end 46. The second arm 48 is rectangular in cross-sectional shape and is constructed of shape retentive resilient material such as rubber. Further, the arm 48 includes longitudinally extending internal reinforcing threads (not shown).

The arm 48 includes a second end 54 from which a ball hitch socket assembly 56 of conventional design is supported through the utilization of a clamp plate 58 and a plurality of fasteners 60 secured through the clamp plate 58, the second end 54 of the arm 48 and a mounting plate portion 62 of the assembly 56.

In addition, the longitudinal midportion of the arm 34 includes a pair of opposite side depending mounting lugs 64 between which one end of an airplane-type shock absorber 66 is pivotally anchored through the utilization of a fastener 68. The other end of the shock absorber 66 includes a mounting shank portion 70 secured through an outwardly projecting end 62 of the clamp plate 58.

The vessel 20 has a pair of cantilever supported outboard ball hitch elements 74 supported therefrom by mounting brackets 76 and the assemblies 56 are releasably engageable with the hitch elements 74 in the conventional manner whereby each assembly 56 is universally anchored to the corresponding hitch element 74.

When the vessel 20 is moored to the dock 10 through the utilization of the mooring arm structures 24, the vessel 20 may experience roll, pitch and yaw movements relative to the dock 10. The longitudinal midportions of the second arms 48 enable the second ends 54 of the arms 48 to be laterally deflected toward and away from the corresponding sleeves 38 and also allow some rotational movement of the second ends 54 relative to the first ends 46 about the longitudinal center axes of the arms 48, the securement of the shanks 70 to the ends 72 of the clamp plates 58 being rubber bushed and the pivotal connection of the sleeves 38 relative to the mounts 26 being rubber bushed.

Figure 6:
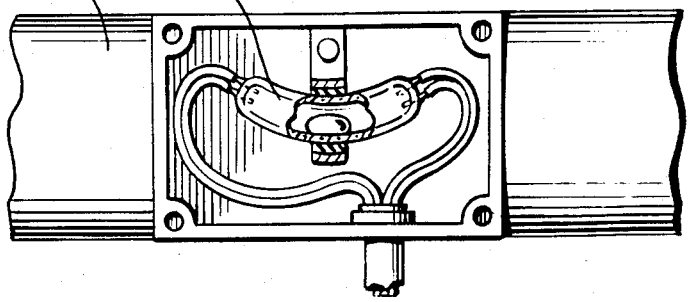
FIG. 6 is an enlarged fragmentary elevational view illustrating the mooring arm mounted mercury control switch for the reversible electric motor of the modified form illustrated in FIG. 5.
Figure 3:
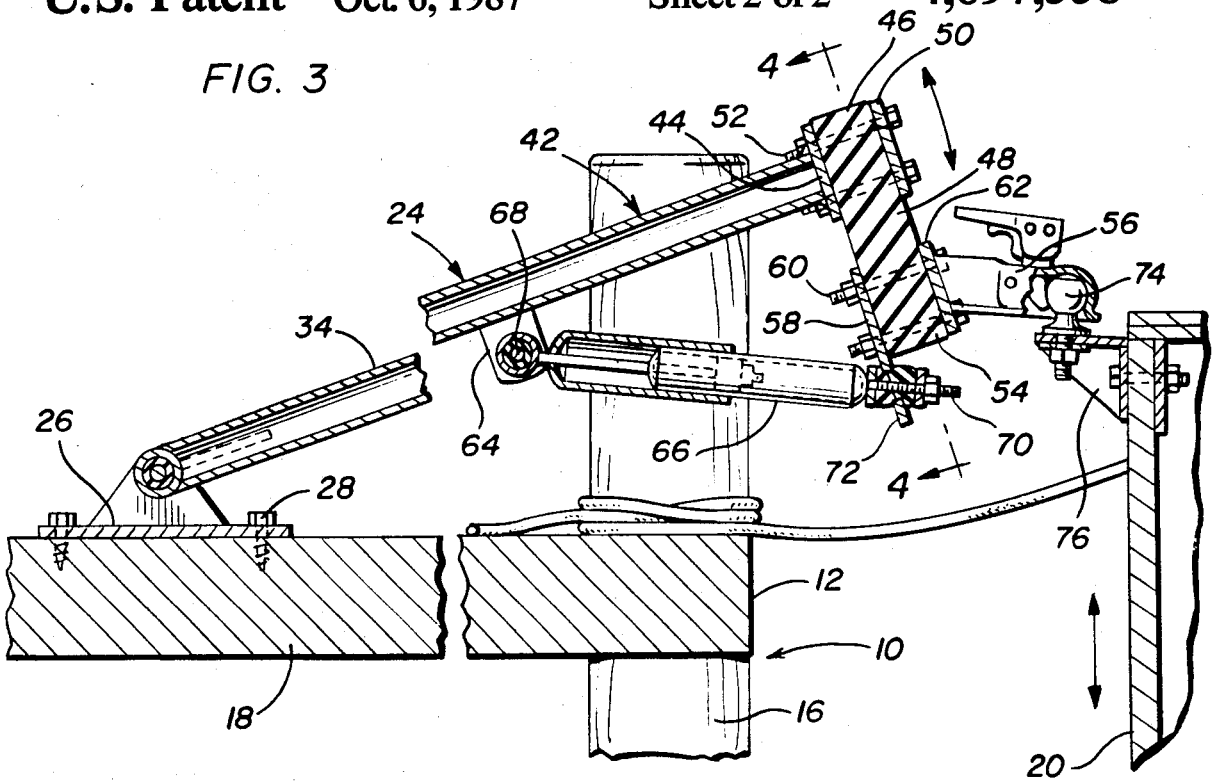
FIG. 3 is an enlarged fragmentary vertical sectional view taken substantially upon the plane indicated by the section line 3—3 of FIG. 2.
Figure 5:
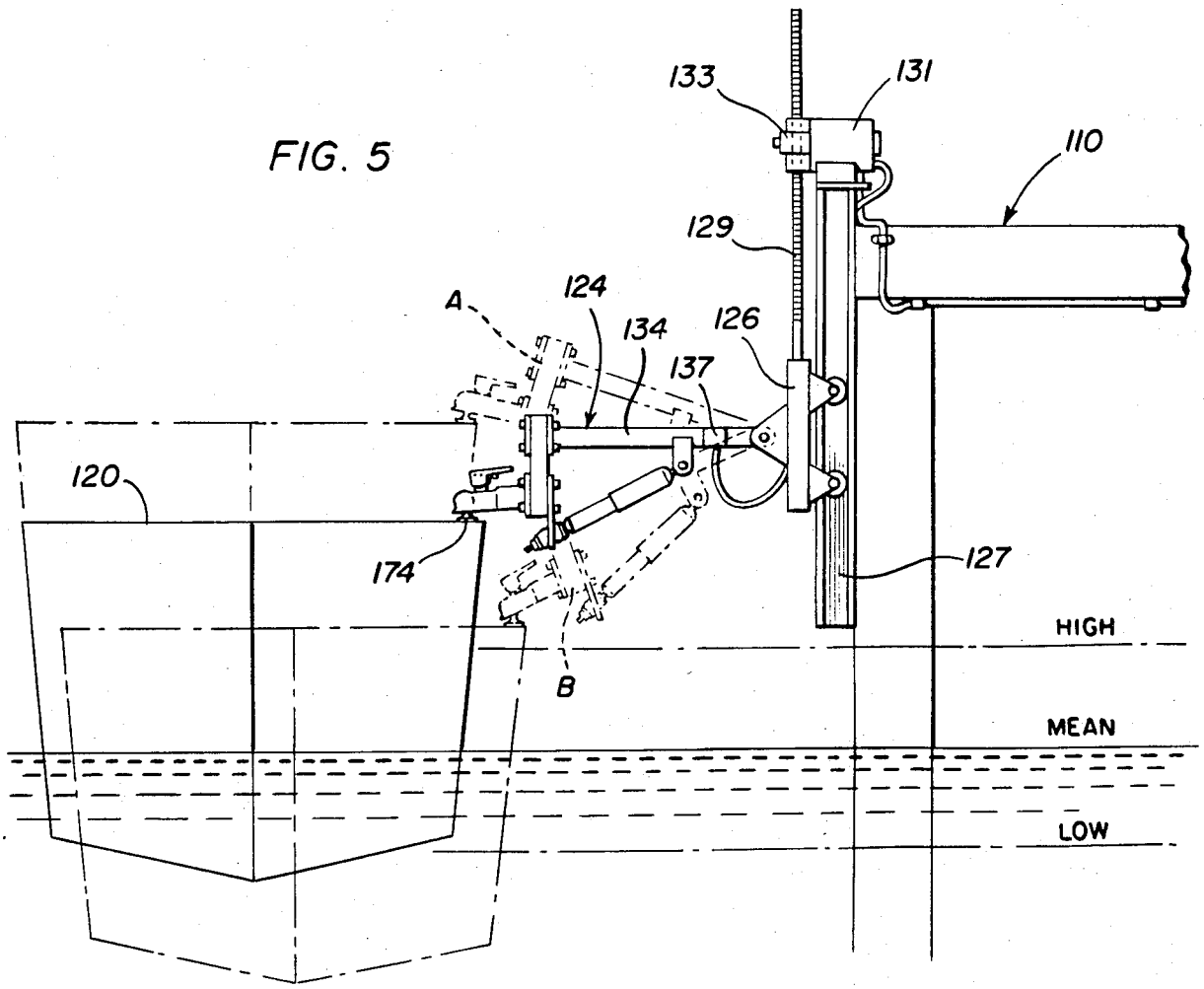
FIG. 5 is a bow elevational view of a water vessel moored to a dock through the utilization of a modified form of boat mooring device capable of compensating for tides above and below normal high and low tides.

With attention invited more specifically to FIG. 5 of the drawings, there may be seen a modified form of mooring arm structure 124 corresponding to the mooring arm structure 24. The mooring arm structure 124 includes a mount 126 corresponding to the mount 26, but which is guidingly supported from an upstanding I-beam guide member 127 from a dock 110 corresponding to the dock 10. In addition, the mount 126 includes an upstanding rack gear 129 and the upper end of the guide member 127 supports a reversible electric motor 131 therefrom including a gear reduction assembly 133 having an output pinion gear (not shown) meshed with the rack gear 129. In addition, the longitudinal midportion of the arm 134 of the mooring arm structure 124 includes an arm inclination responsive switch 137 for reversibly actuating the electric motor 131. When the arm 134 is horizontally disposed as illustrated in FIGS. 5 and 6, the switch 137 is inoperative to actuate the motor 131. However, when the mooring arm structure 124 is upwardly and outwardly inclined as indicated at A in FIG. 5, the switch 137 is operative to actuate the motor 131 in order to raise the rack gear 129 relative to the gear reduction assembly 133 and when the mounting arm structure 124 is downwardly and outwardly inclined as indicated at B in FIG. 5, the switch 137 actuates the motor 131 in order to lower the rack gear 129 relative to the gear reduction assembly 133. In this manner, the mooring arm structure 124 is operative to compensate for tides higher than normal high tide and tides lower than normal low tides. Otherwise, the mooring arm structure 124 is identical to the mooring arm structure 24.

However, the vessel 120 illustrated in FIG. 5 and corresponding to the vessel 20 includes inboard mounted hitch elements 174 corresponding to the hitch elements 74 and either vessel 20 or 120 may include outboard or inboard hitch elements corresponding to the hitch elements 74 and 174.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A boat mooring device including a mount mounted from a dock portion, an elongated generally horizontally disposed first arm including first and second ends, pivot means pivotally securing said first end to said mount for angular displacement relative thereto about a generally horizontal axis extending transversely of said arm, an elongated second arm including first and second ends, mounting means mounting said second arm first end to said first arm second end with said second arm disposed generally transverse to said first arm and said second arm second end projecting outwardly of one side of said first arm, said second arm including at least a central portion intermediate its opposite ends constructed of shape retentive resilient material, whereby lateral deflection of said second arm second end from a static position thereof, toward and away from said first end of said first arm and relative angular displacement of said second arm first and second ends may occur and said second arm central portion will yieldingly resist said deflection and angular displacement, anchor means carried by said second end of said second arm for releasable connection with a water vessel mooring fixture, and movement dampening means connected between the second end of said second arm and said first arm intermediate said first and second ends of said first arm for controllably retarding movement of the second end of said second arm toward and away from said first end of said first arm.

2. The mooring device of claim 1 including a water vessel docking facility incorporating means defining a dock structure having a generally straight marginal portion alongside of which an elongated water vessel may be disposed, a second mooring device corresponding to the first mentioned mooring device, the mounts of said mooring devices being supported from said marginal portion with said mounts spaced along said marginal portion and said second arm ends projecting horizontally outwardly beyond said marginal portion.

3. The mooring device of claim 1 wherein said anchor means includes means for releasable universal connection with said water vessel mooring fixture.

4. The mooring device of claim 1 wherein said second arm comprises an elongated member constructed a rubber-like material.

5. The mooring device of claim 4 wherein said second arm includes internal reinforcing fibers extending longitudinally of said second arm.

6. The water vessel docking facility of claim 2 wherein each of said mounts is supported from said marginal portion for guided vertical shifting therealong.

7. The water vessel docking facility of claim 6 including means operatively connected between each of said mounts and said dock portions for automatically shifting said mounts upwardly and downwardly relative to said dock portions responsive to excessive upward and downward movements, respectively, of said second ends of said first arms relative to the corresponding mounts.

8. The mooring device of claim 2 wherein each of said anchor means includes means for releasable universal connection with a corresponding water vessel mooring fixture.

* * * * *